US005859580A

United States Patent [19]

Hashizawa et al.

[11] Patent Number: 5,859,580

[45] Date of Patent: Jan. 12, 1999

[54] SERVICE PLUG HAVING MALE AND FEMALE TERMINALS PERMANENTLY COUPLED TO THE SERVICE PLUG FOR CLOSING A PROTECTED CIRCUIT

[75] Inventors: Shigemi Hashizawa; Hidehiko Kuboshima, both of Shizuoka, Japan

[73] Assignee: Yazaki Corporation, Tokyo, Japan

[21] Appl. No.: 925,001

[22] Filed: Sep. 5, 1997

[30] Foreign Application Priority Data

Sep. 5, 1996 [JP] Japan ..... 8-235430

[51] Int. Cl.[6] ..... H01H 85/143

[52] U.S. Cl. ..... 337/260; 337/255; 337/4; 337/268; 361/630; 361/104

[58] Field of Search ..... 337/255, 260, 337/268, 4, 12; 81/3.8; 361/627, 628, 630, 641, 642, 656, 833, 835, 837, 103, 104

[56] References Cited

U.S. PATENT DOCUMENTS

| | | | |
|---|---|---|---|
| 1,946,071 | 2/1934 | Harvey | 361/835 X |
| 2,902,631 | 9/1959 | McRoberts et al. | 361/835 X |
| 4,536,046 | 8/1985 | Erickson | 337/268 X |
| 4,559,504 | 12/1985 | Krec | 361/835 X |
| 4,800,358 | 1/1989 | Takenouchi et al. | 337/268 |

FOREIGN PATENT DOCUMENTS

| | | |
|---|---|---|
| 64-31651 | 2/1989 | Japan . |
| 2-70339 | 5/1990 | Japan . |
| 3-126345 | 12/1991 | Japan . |

*Primary Examiner*—Leo P. Picard
*Assistant Examiner*—Jayprakash N. Gandhi
*Attorney, Agent, or Firm*—Sughrue, Mion, Zinn, Macpeak & Seas, PLLC

[57] ABSTRACT

A service plug includes a circuit accommodating body that has circuit terminals internally arranged therein, the circuit terminals being connected to end portions of an open electric circuit; and a plug main body that has a fuse and that is fitted with the circuit accommodating body. The plug main body has a pair of terminals that are electrically connected to fuse terminals of the fuse and that are engageable with the circuit terminals, respectively.

12 Claims, 6 Drawing Sheets

SERVICE PLUG HAVING MALE AND FEMALE TERMINALS PERMANENTLY COUPLED TO THE SERVICE PLUG FOR CLOSING A PROTECTED CIRCUIT

BACKGROUND OF THE INVENTION

1. Field of the Invention

This invention relates to circuit switchgears (service plugs) that can open electric circuits to interrupt circuit current. More specifically, the invention is directed to a service plug for use in closing and opening high-voltage circuits and large-current circuits that include wiring harnesses in electric cars and the like.

2. Background

For example, a conventional switchboard for a high-voltage circuit has been designed in the following manner. When a cover of the switchboard is opened, a male connector fixed to the cover is pulled out of a corresponding female connector fixed to a main body of the switchboard, thereby electrically interrupting the conduction of the high-voltage circuit. Therefore, considerations are given so that there is no possibility that the operator erroneously touches the electrodes and receives an electric shock.

On the other hand, a transportation equipment such as an electric car includes a high-voltage section for driving a motor. Therefore, considerations must be given so that there is no possibility that the operator receives an electric shock when he or she services a vehicle. Particularly, since specialists and also ordinary people can be involved in car maintenance and repair, so that decisive measures against electric shock must be taken.

In order to overcome this problem, for example, a circuit switchgear such as a fuse box serving as a safety plug, by which a conduction of a high-voltage circuit is electrically interrupted has been arranged in a conventional electric car. Therefore, the operator opens the cover of the fuse box before servicing the car such as making a circuit inspection and replacing fuses, so that safety can be ensured.

Such conventional fuse box serving also as the safety plug is shown in FIGS. 6 and 7.

As shown in FIGS. 6 and 7, a fuse box 101 includes a housing 102 in which a pair of terminals 112 arranged at a predetermined distance. The housing 102 has a rectangular shape and is formed from an insulating material. The terminals 112 have wires 115 connected to the rear ends thereof, respectively. As shown in FIG. 8, terminals 112 each has a holding portion 113 which is formed by press-working a metal sheet and is substantially U-shaped so that the holding portion 113 is resiliently deformable. Further, the terminals 112 each has an LA terminal 117 having a wire clamping portion 116. A wire 115 is connected to the wire clamping portion 116 formed at one end portion of the LA terminal 117, and the holding portion 113 is connected to the other end of the LA terminal 117.

On the other hand, a cover 104 is pivotally arranged on the upper portion of the housing 102. A cylindrical fuse 107 shown in FIG. 9 is fixed to an inner surface of the cover 104 with a band 109. The fuse 107 has a pair of fuse terminals 107*a* formed on both end portions thereof, the fuse terminals 107*a* are arranged so as to be engageable with the holding portions 113 of the terminals 112, respectively, when the cover 104 is closed.

Therefore, when the cover 104 is opened, the fuse box 101 disengages the fuse terminals 107*a* from the terminals 112 that are respectively connected to the wires. As a result, the wires are put into electrically interrupt conduction. Accordingly, the circuit can be broken completely as well as safely.

In the above constructed conventional circuit switchgear, a contact reliability between the fuse terminals 107*a* and the terminals 112 connected to the wires depends greatly on a resilient efficiency of the holding portions 113 which is designed to hold the fuse terminals 107*a* therebetween, and a dimensional accuracy of the fuse terminals 107*a*. However, since a thickness C of the fuse terminal 107*a* (see FIG. 9) is not specified for a connecting terminal, a wide range of tolerances is usually given to such thickness. Accordingly, it is difficult to ensure the reliability of contact between the fuse terminals 107*a* and the holding portions 113.

Furthermore, at the time of replacing fuses, a fuse 107 attached newly to the cover 104 must be fixed with a band while correctly regulating the position thereof so that the fuse terminal 107*a* is inserted into the holding portion 113 vertically. Accordingly, there is a possibility to lose the resiliency of the holding portions 113 by unnecessarily expanding the holding portions 113. In addition, it may be caused that the holding portions 113 will not be engageable with the fuse terminals 107*a*. Hence, an enormous amount of time and attention has been entailed for the fuse replacing operation.

SUMMARY OF THE INVENTION

The invention has been made to overcome the aforementioned problems. The object of the invention is, therefore, to provide a circuit switchgear (service plug) that can ensure the reliability of contact between the fuse terminals and the circuit terminals connected to the end portions of an open electric circuit, and facilitate fuse replacement.

To overcome the above object, the invention is applied to a service plug that includes: a circuit accommodating body including terminal insertion holes functioning as circuit receiving terminals which are connected to end portions of an electric circuit which is electrically opened; and a plug main body including, a fuse having a pair of fuse terminals, and terminals electrically connected to the fuse terminals, respectively, the terminals being engageable with the circuit terminals, the plug main body which is detachably fitted to the circuit accommodating body to electrically close the electric circuit in accordance with the engagement of the terminals of the plug main body and the circuit terminals.

Further, the service plug may include a lever which can be pivotally coupled to the plug main body, the lever allowing the plug main body to be detachably attached to the circuit accommodating body.

The above service plug may be constructed so that the fuse has through holes arranged in the fuse terminals, the terminals of the plug main body pass respectively through the through holes, and nuts are attached to the terminals of the plug main body so that the fuse is held by the plug main body.

In the thus constructed service plug, the terminals belonging to the plug main body, which can establish conduction between the pair of circuit terminals arranged within the box so as to be connected to the wires, are provided as dedicated terminals independent of the fuse terminals. Therefore, reliability of contact can be ensured. In addition, as a result of the structure in which the fuse terminals can be attached to the terminals belonging to the plug main body with nuts, the fuses can be replaced simply as well perfectly during maintenance.

DETAILED DESCRIPTION OF THE PREFERRED EMBODIMENT

Figure 1:
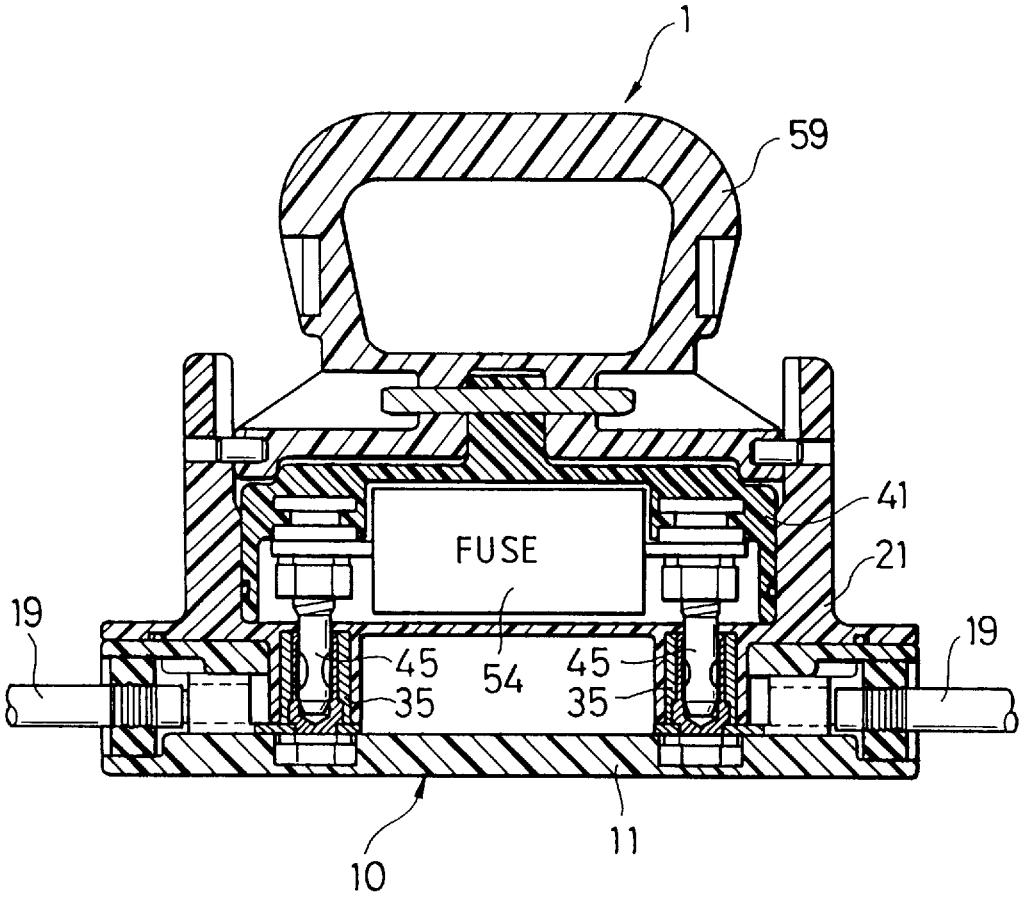
FIG. 1 is a longitudinal sectional view of a service plug of the invention.
Figure 2:
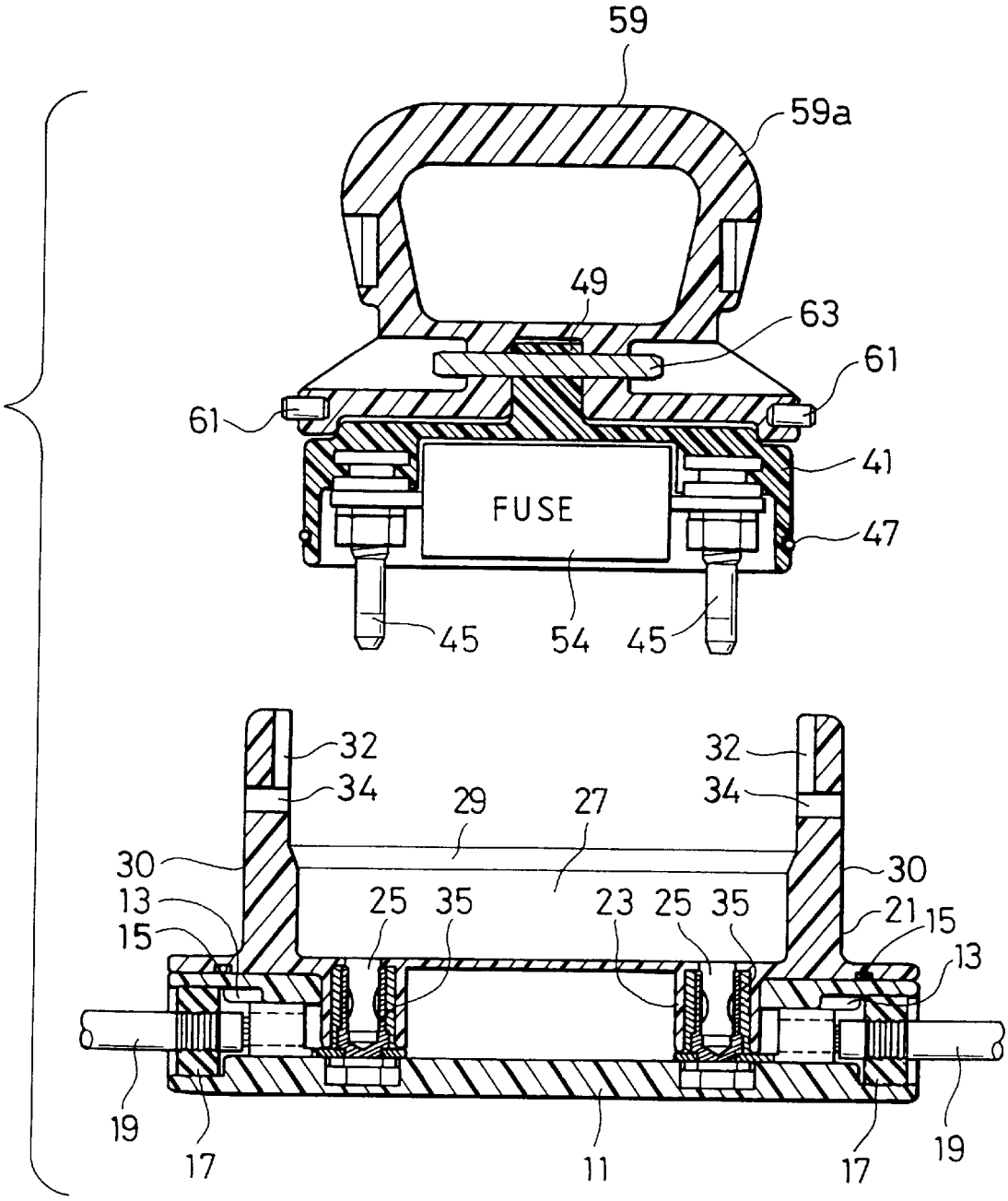
FIG. 2 is a longitudinal sectional view of the service plug shown in FIG. 1 with a plug main body removed.

A service plug, which is a mode of embodiment of the invention, will now be described in detail with reference to FIGS. 1 to 5.

A service plug 1, which is a circuit switchgear, includes a circuit accommodating body 10 and a plug main body 41 that is detachably attached to the circuit accommodating body 10.

The circuit accommodating body 10 includes a box section 11 and a cover 21. The box section 11 is formed of an insulating material and has a rectangular shape. An upper portion of the box section 11 is opened. The box section 11 includes a pair of circuit terminals 35, 35 internally arranged in the box section 11 to form an open electric circuit. The circuit terminals 35, 35 are arranged at a predetermined distance, and wires 19 connected to rear portions of the circuit terminals 35, 35, respectively. The cover 21 is mounted over the upper portion of the box section 11 so as to be integrated with the box section 11.

The plug main body 41 holds a cylindrical fuse 54, and has a pair of terminals 45, 45 that are engageable with the circuit terminals 35, 35 within the box section 11 respectively so as to pass through the cover 21. Each terminal 45 is a male terminal, and has a rod-like shape. Further, the plug main body 41 has a lever 59 that can be pivotally coupled to the upper surface of the plug main body 41.

Further, the construction of the respective parts will now be described with reference to FIGS. 3 to 5.

Figure 3:
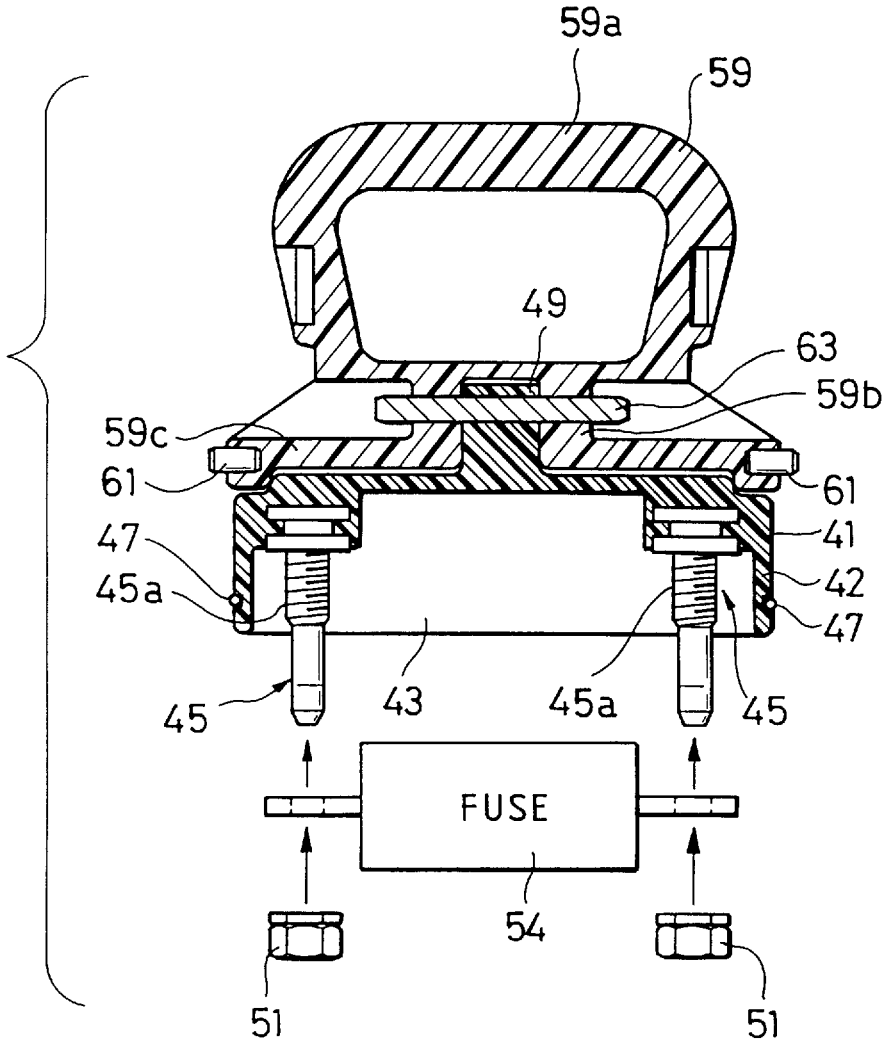
FIG. 3 is a longitudinal sectional view of the plug main body in an exploded condition.

As shown in FIG. 3, the plug main body 41 holds the terminals 45 so as to hang down by insert molding, and has a hood 42 formed integrally therewith at an outer side surrounding the male terminals 45, the hood 42 having an opening at the lower portion thereof. The plug main body 41 can accommodate the fuse 54 within a space 43 surrounded by the hood 42.

It may be noted that the male terminals 45 are long enough to project from the bottom of the hood 42. Further, a male screw thread 45*a* is formed in the middle of each male terminal 45.

Still further, a watertight packing 47 is fitted over the outer circumference of the hood 42.

Figure 4:
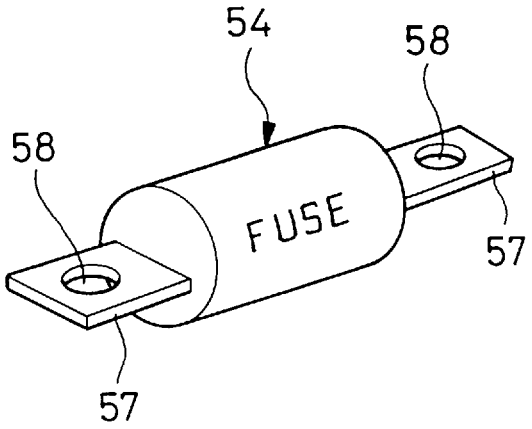
FIG. 4 is a perspective view showing the appearance of a fuse.

As shown in FIG. 4, the fuse 54 includes fuse terminals 57 having engaging through holes 58 formed therein. The fuse terminals 57 are arranged to project from both ends of the fuse 54. The through holes 58 allow the male terminals 45 to be inserted thereinto.

Further, as shown in FIG. 3, the fuse 54 is accommodated in the space 43 within the plug main body 41 after the male terminals 45 have been inserted respectively into the through holes 58 and then nuts 51 are tightened onto the screw threads 45*a*.

A rotary shaft coupling portion 49 is projected from the upper surface of the plug main body 41. The lever 59 is mounted on the upper surface of the plug main body 41. A rotary shaft 63 passes through the rotary shaft coupling portion 49 and a base portion 59*b* of the lever 59 so that the lever 59 can be pivotally coupled to the plug main body 41.

Bosses 61 project from both sides of a lower portion 59*c* of the lever 59 which is located lower than the base portion 59*b*. It may be noted that a handle portion 59*a* is formed at a position opposite to the lower portion 59*c*.

The pair of circuit terminals 35, 35 are arranged inside the box section 11 through terminal insertion holes 13.

Figure 5:
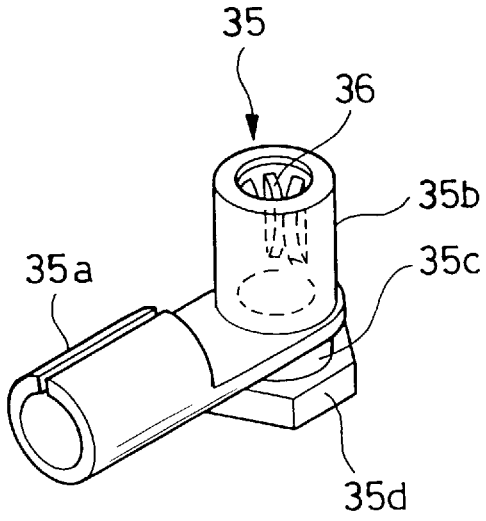
FIG. 5 is a perspective view of a terminal to be incorporated into a box section in an assembled condition.
Figure 6:
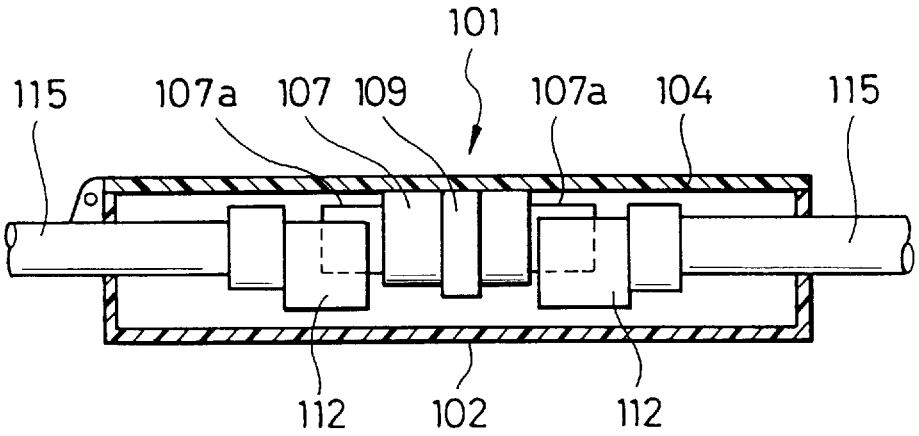
FIG. 6 PRIOR ART
FIG. 6 is a diagram illustrative of an operation of a conventional fuse box.
Figure 7:
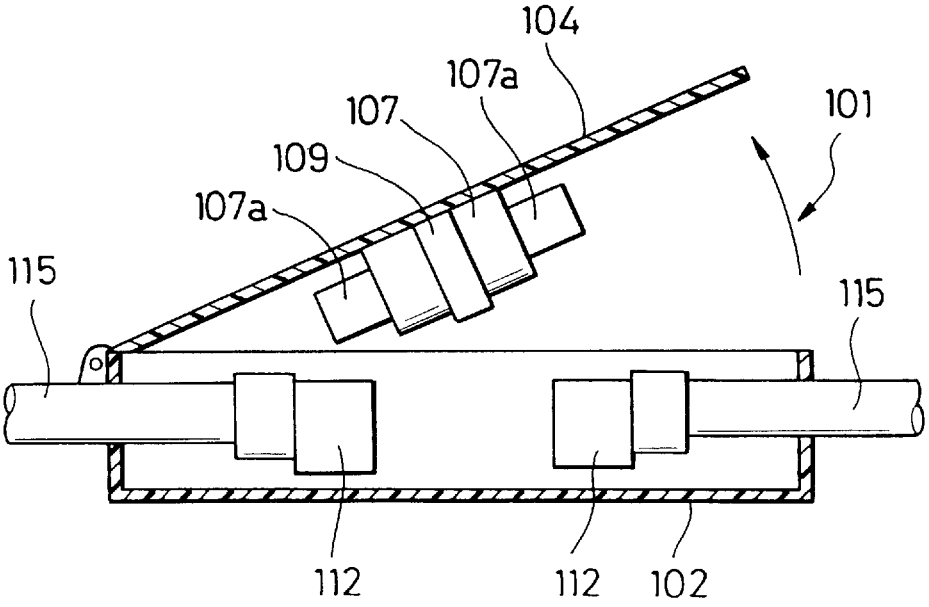
FIG. 7 PRIOR ART
FIG. 7 is a diagram illustrative of an operation of the conventional fuse box.
Figure 8:
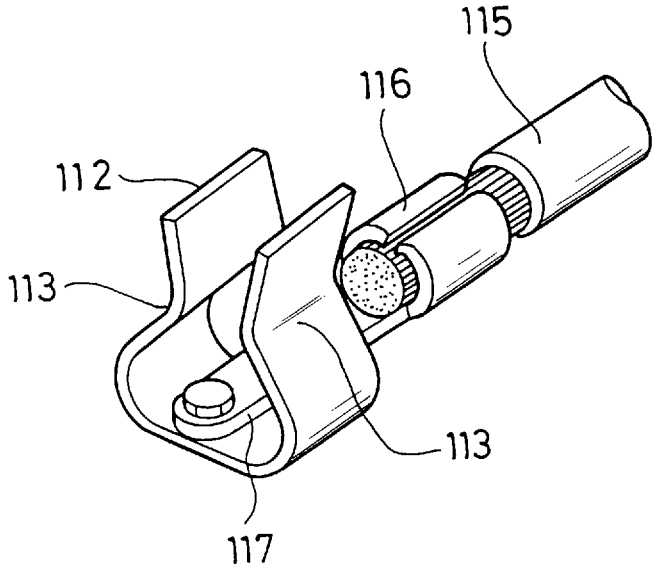
FIG. 8 PRIOR ART
FIG. 8 is a perspective view of a fuse to be applied to the conventional fuse box.
Figure 9:
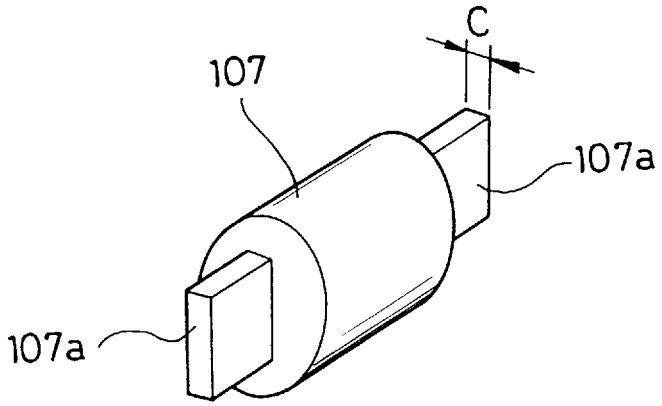
FIG. 9 PRIOR ART
FIG. 9 is a perspective view of a terminal to be applied to the conventional fuse box.

As shown in FIG. 5, each of the circuit terminals 35, 35 is a female terminal, and has an LA terminal 35*a* that connects a wire 19 to the circuit terminal and a cylindrical socket portion 35*b* into which the male terminal 45 is inserted for electrically connecting. Further, a male screw thread (not shown) is formed on the lower end of the socket portion 35*b*. The LA terminal 35*a* is coupled with the socket portion 35*b* by a nut 35*d* while interposing a lock washer 35*c* between the bottom end of the socket portion 35*b* and the nut 35*d*. Furthermore, a contact spring 36 is arranged over the inner circumferential wall of the socket portion 35*b* so that the conductivity of the circuit terminal 35 with the corresponding male terminal 45 can be improved.

The box section 11, as described above, has the upper portion which is opened. The cover 21 is coupled to the thus opened box section 11 integrally therewith by screws (not shown). A seal member 15 is interposed between the box section 11 and the cover 21 for sealing. Further, a rubber plug 17 is fitted between the wire 19 connected to each female terminal 35 and the corresponding terminal insertion hole 13.

The cover 21 has housings 23 formed on the lower surface side of the cover 21. The housings 23 serve to respectively accommodate the socket portions 35*b* of the female terminals 35 therein. Further, terminal insertion holes 25 are bored in a surface of the cover 21, and correspond to the socket portions 35*b* of the female terminals 35, respectively. Accordingly, the male terminals 45 are connectable to the female terminals 35 through the terminal insertion holes 25, respectively.

A circumferential wall 29 is formed on the upper surface side of the cover 21 so as to extend upwardly (toward the upper portion as viewed in FIG. 2) and so as to be opened. The circumferential wall 29 has an accommodating space 27 that allows the plug main body 41 holding the fuse 54 to be guided and inserted thereinto, and accommodates the plug main body 41 therein.

Guide grooves 32 are formed in the upper ends of a pair of guide walls 30 of the circumferential wall 29. The pair of guide walls 30 are positioned along the longitudinal direction of the box section 11 (in horizontal directions as viewed in FIG. 2). The guide grooves 32 extend in a vertical direction from the top ends of the confronting surfaces of the guide walls 30. The guide grooves 32 allow the bosses 61 of the lever 59 to be engaged therewith. Further, evacuation grooves 34 communicating with the guide grooves 32 are formed at end portions of the guide grooves 32.

In the service plug 1 as described above, the plug main body 41 holding the fuse 54 is guided down with the bosses 61 of the lever 59 engaged with the guide grooves 32 and inserted into the accommodating space 27 of the cover 21 when the handle portion 59*a* of the lever 59 has been pressed. When the plug main body 41 is inserted into the accommodating space 27, the space between the hood 42 of the plug main body 41 and the circumferential wall 29 of the cover 21 is made watertight by the packing 47. The male terminals 45 are fitted into the female terminals 35 while passing through the terminal insertion holes 25 formed in the cover 21. Accordingly, the wires 19 respectively connected to the pair of female terminals 35 form an electric circuit while establishing conduction through the fuse 54. It may be noted that the lever 59 is turned about the rotary shaft 63 and folded down by the bosses 61 having evacuated into the evacuation grooves 34 under the condition in which the circuit has been formed, so that unnecessary interference of the lever 59 with other members can be avoided.

On the other hand, the circuit is interrupted by reversely following the aforementioned operating procedure at the time of maintaining the electric circuit into which this service plug 1 has been incorporated or replacing fuses.

That is, when the lever 59 is erected and pulled upwardly by the handle portion 59*a*, the bosses 61 slide along the guide grooves 32. Accordingly, the male terminals 45 are released from the female terminals 35, and further, the plug main body 41 moves away from the accommodating space 27. Then, when the lever 59 and the plug main body 41 are completely pulled out of the box section 11 and the cover 21, conduction between the wires 19 respectively connected to the pair of female terminals 35 is interrupted, which in turn makes the electric circuit to be broken. Accordingly, maintenance of the electric circuit can be performed safely.

While the circuit terminals are female and the terminals on the plug main body are male in the aforementioned mode of embodiment, the invention is, of course, applicable to a mode of embodiment in which the circuit terminals are male and the terminals on the plug main body are female. Further, a pair of circuit terminals may be formed of a combination of a female terminal and a male terminal and so may be a pair of terminals on the plug main body.

As described in the foregoing in detail, according to the service plug of the invention, the plug main body has dedicated terminals that are separate from the fuse terminals. Therefore, the dimensional accuracy problem encountered in the conventional example when the fuse terminals are directly used can be overcome, and the reliability of contact between terminals can therefore be improved as well. In addition, since these terminals on the plug main body are dedicated terminals, the service plug of the invention is applicable also to large-current, high-voltage circuits with reliability of connection ensured.

Moreover, the terminals on the plug main body can be set only by inserting the terminals into the through holes formed in the fuse terminals and fixing the inserted terminals with nuts, which frees the user of the cumbersome operation restricted by the fuse mounting direction in the conventional example. Hence, the service plug of the invention allows simple fuse replacing operation to be performed with ease.

What is claimed is:

1. A service plug, comprising:

a circuit accommodating body, including circuit terminals which are connected to respective end portions of an electric circuit which is electrically opened; and a plug main body including:

a fuse having a pair of fuse terminals, and main body terminals formed on said main body, said main body terminals being connectable to said pair of fuse terminals, respectively, said main body terminals further being connectable to said respective circuit terminals;

wherein said plug main body is detachably coupled to said circuit accommodating body so as to electrically close the electric circuit by connecting said main body terminals to said respective circuit terminals.

2. The service plug of claim 1, wherein said fuse further includes through holes formed in said fuse terminals, respectively, for receiving said respective main body terminals therethrough, and wherein nuts are attached to said main body terminals so that said fuse is held by said plug main body.

3. The service plug of claim 1, further comprising a lever for detaching said plug main body from said circuit accommodating body, and wherein said lever is pivotally coupled to said plug main body so that said lever can be stored against said plug main body.

4. The service plug of claim 1, wherein said fuse further includes through holes formed, respectively, in said fuse terminals for receiving said respective main body terminals therethrough.

5. A circuit switchgear, comprising:

a first unit including:

a first housing, and first terminals formed in said first housing; and a second unit detachably coupled to said first unit, said second unit including:

a second housing, a fuse having a pair of fuse terminals, and second terminals arranged in said second housing adaptable to be electrically connected to said fuse terminals, respectively; wherein when said second unit is coupled to said first unit, said first terminals are electrically connected to said respective second terminals so as to electrically connect said first terminals with each other through said fuse.

6. The circuit switchgear of claim 4, wherein said fuse further comprises:

through holes formed in said fuse terminals, respectively, and wherein said second terminals pass through said respective through holes; and nuts attached to said respective second terminals so that said fuse is held by said second unit.

7. The circuit switchgear of claim 5, further comprising a lever for detaching said second unit from said first unit, and wherein said lever is pivotally coupled to said second unit so that said lever can be stored against said second unit.

8. The circuit switchgear of claim 5, wherein said first housing includes an opening portion, and wherein said first terminals and said second terminals are connected to each other in said opening portion.

9. The circuit switchgear of claim 8, wherein said first unit further includes:

a cover portion which is mounted on said first housing, said cover portion having terminal housings for receiving electrical contact portions of said first terminals, and a guide wall for guiding said second unit when said second unit is coupled to said first unit.

10. The circuit switchgear of claim 5, wherein said first unit further includes:

a cover portion which is mounted on said first housing, said cover portion having terminal housings for receiving electrical contact portions of said first terminals, and a guide wall for guiding said second unit when the second unit is coupled to said first unit.

11. The circuit switchgear of claim 10, wherein said guide wall has grooves formed therein and said second housing has bosses, and wherein when said second unit is coupled to said first unit, said bosses move along said grooves.

12. The circuit switchgear of claim 5, wherein said fuse further comprises through holes formed, respectively, in said fuse terminals, and wherein said second terminals pass through said respective through holes.

* * * * *